United States Patent [19]

Singer

[11] Patent Number: 4,619,884

[45] Date of Patent: Oct. 28, 1986

[54] PHOTOGRAPHIC PRODUCTS EMPLOYING NONDIFFUSIBLE N',N'-DIAROMATIC CARBOCYCLIC—OR DIAROMATIC HETEROCYCLIC—SULFONOHYDRAZIDE COMPOUNDS CAPABLE OF RELEASING PHOTOGRAPHICALLY USEFUL GROUPS

[75] Inventor: Stephen P. Singer, Rochester, N.Y.

[73] Assignee: Eastman Kodak Company, Rochester, N.Y.

[21] Appl. No.: 759,786

[22] Filed: Jul. 29, 1985

[51] Int. Cl.[4] ..... G03C 1/40; G03C 5/54; G03C 1/34; G03C 1/42

[52] U.S. Cl. ..... 430/223; 430/212; 430/217; 430/218; 430/219; 430/542; 430/543; 430/559; 430/562; 430/564; 430/566; 430/591; 430/598; 430/600; 430/603; 430/606; 430/611; 430/621; 430/955; 430/957; 430/959

[58] Field of Search ..... 430/955–960, 430/505, 544, 564, 562, 551, 550, 606, 607, 611, 613, 621, 223, 218, 559, 219, 543, 566, 598, 603, 600, 212, 542, 217, 591

[56] References Cited

U.S. PATENT DOCUMENTS

| | | | |
|---|---|---|---|
| 4,278,748 | 7/1981 | Sidhu et al. | 430/598 |
| 4,369,243 | 1/1983 | Credner et al. | 430/223 |
| 4,430,420 | 2/1984 | Adin | 430/619 |

OTHER PUBLICATIONS

Research Disclosure, May 1977, #15776, pp. 67–68.
Research Disclosure, Oct. 1978, #17465, p. 64.
Research Disclosure, vol. 128, Dec. 1974, Item No. 12823, pp. 22 to 25 (Application p. 1, lines 25–26).

*Primary Examiner*—Richard L. Schilling
*Attorney, Agent, or Firm*—Thomas F. Kirchoff

[57] ABSTRACT

Photographic elements and assemblages are described which employ nondiffusible N',N'-diaromatic carbocyclic—or diaromatic heterocyclic—sulfonohydrazide compounds which are capable of releasing photographically useful groups in an imagewise manner as a function of silver halide development.

13 Claims, No Drawings

PHOTOGRAPHIC PRODUCTS EMPLOYING NONDIFFUSIBLE N',N'-DIAROMATIC CARBOCYCLIC—OR DIAROMATIC HETEROCYCLIC—SULFONOHYDRAZIDE COMPOUNDS CAPABLE OF RELEASING PHOTOGRAPHICALLY USEFUL GROUPS

This invention relates to photography and more particularly to color diffusion transfer photography employing novel nondiffusible sulfonohydrazide compounds capable of releasing diffusible photographically useful groups.

The release of diffusible photographically useful groups from nondiffusible compounds is well known in photographic technology. However, the manner of releasing a desired group is only a part of the overall consideration. Some released groups fall short of providing properties which are required to assure acceptable photographic image quality, particularly in color diffusion transfer processes.

U.S. Pat. No. 4,369,243 describes sulfilimine compounds which release diffusible photographically active moieties. Investigation of these compounds reveals that although an acceptable rate of dye release can be obtained the resulting images have less than acceptable sensitometric properties, in particular, low Dmax and high Dmin values.

*Research Disclosure,* Volume 128, December 1974, Item 12823, pages 22 to 25, describes sulfohydrazide dye-releasing compounds for photographic color diffusion transfer use. These compounds release a dye moiety as a result of rupturing a sulfur-nitrogen bond so that the released dye moiety has a free $SO_3$- radical attached thereto which imparts very high solubility to the released dye in alkaline media.

Attempted use of dyes having free sulfonic acid radicals in alkaline environment has been less than satisfactory due to a tendency toward image smearing. It is believed this smearing problem is caused by the high solubility of such dyes in the alkaline environment encountered in color diffusion transfer processing. This solubility leads to rapid diffusion of released dyes in all directions in a photographic recording material. This rapid diffusion, and resulting smearing, renders the dyes unacceptable for commercial use.

Accordingly, it is desirable to provide a nondiffusible compound capable of rapid and efficient release of a photographically useful group, as a function of silver halide development, in color diffusion transfer photographic elements and assemblages, which group will provide acceptable photographic properties.

One embodiment of this invention provides a photographic element comprising a support having thereon at least one photsensitive silver halide emulsion layer having associated therewith a nondiffusible N',N'-diaromatic carbocyclic- or diaromatic heterocyclic-sulfonohydrazide compound capable of releasing a diffusible photographically useful group, or precursor thereof, wherein at least one of said aromatic groups comprises a nitro substituent in the 2- position or in a position conjugated thereto.

In a preferred embodiment of this invention the N',N'-di-aromatic carbocyclic- or diaromatic heterocyclic-sulfonohydrazide compound is represented by the structural formula:

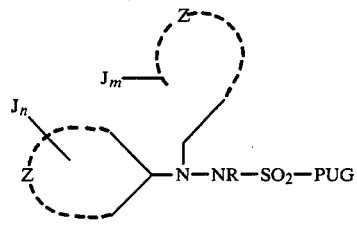

where each Z independently represents the atoms necessary to complete a substituted or an unsubstituted one- or a two-ring carbocyclic or heterocyclic group containing 5 to 7 nuclear atoms in each ring;

J is a nitro group substituted in the 2- position or in a position conjugated thereto;

m and n are each integers of 0, 1 or 2 with the proviso that either m or n is at least 1;

R is hydrogen or an alkyl group having from 1 to about 6 carbon atoms; and

PUG is a photographically useful group.

The type of rings which Z can complete include, for example, benzene, pyridine, diazine, naphthalene, quinoline, furan, thiophene, pyrrole, isoxazole, benzofuran, benzothiofuran, indole, indene and azulene.

As noted above, Z can represent the atoms necessary to complete a substituted or an unsubstituted one- or two-ring carbocyclic or heterocyclic group containing 5 to 7 nuclear atoms in each ring. Substituents, other than one or more nitro groups as defined above for J, can include a straight or branched chain alkyl or alkoxy group having from 1 to about 30 carbon atoms; an aryl group having from 6 to about 30 carbon atoms; one or more halogen atoms, for example, chloro, bromo, iodo or fluoro;cyano; a carbamoyl group having the formula —$CON(R^2)_2$ or a sulfamoyl group having the formula —$SO_2N(R^2)_2$, where each $R^2$ independently represents a hydrogen atom; an alkyl or an alkoxy group having from 1 to about 30 carbon atoms or an aryl or an aryloxy group having from 6 to about 30 carbon atoms.

Reference to nondiffusiblity of the N',N'-di-aromatic carbocyclic- or diaromatic heterocyclic-sulfonohydrazide compound is intended to mean that the compound is not free to diffuse out of the layer in which it is coated. Nondiffusibility is a property of the hydrazide compound under both acidic and alkaline conditions, including highly alkaline conditions such as are encountered in a color diffusion transfer processing environment.

Nondiffusibility is commonly imparted to compounds which release photographically useful groups by use of a ballast group substituted on at least one of the carbocyclic or heterocyclic rings completed by Z. The type of ballast group used is not critical so long as it confers the desired nondiffusibility property to the compound. Typical ballast groups include long-chain alkyl radicals, as well as aromatic radicals of the benzene and naphthalene series. Such groups can be linked directly to the carbocyclic or heterocyclic rings completed by Z. Useful ballast groups generally have at least 8 carbon atoms although satisfactory ballasting can be obtained with two or more smaller groups, such as two t-amyl groups. Ballast groups include substituted or unsubstituted alkyl groups having up to about 30 carbon atoms, carbamoyl radicals, having up to about 30 carbon atoms, such as —$CONH(CH_2)_4$—O—$C_6H_3(C_5H_{11})_2$ or —CON($C_{12}H_{25}$)$_2$, or keto radicals having up to about 30 carbon atoms, such as —CO—$C_{17}H_{35}$ or —CO—$C_6H_4$(t—$C_{12}H_{25}$).

Specific examples of ballast groups useful in this invention are described in the November 1976 edition of *Research Disclosure,* pages 68 through 74, and in the April 1977 edition of *Research Disclosure,* pages 32 through 39, the disclosures of which are hereby incorporated by reference.

The photographically useful group (PUG) released by the compounds of this invention can be any group which is desirably made available in a photographic element in an imagewise fashion. The PUG can be an image dye or an image dye precursor. Dye or dye precursor moieties released from the compounds of this invention can include dyes already well known in the art which are suitable for image transfer applications. These dyes or dye precursors are disclosed in one or more of U.S. Pat. Nos. 3,230,085; 3,307,947; 3,579,334 and 3,684,513, and also include the phenylazonaphthyl dyes of U.S. Pat. Nos. 3,929,760; 3,931,144; 3,932,380; 3,932,381; 3,942,987; 3,954,476; 4,001,204 and 4,013,635; the phenylazopyrazoline dyes of U.S. Pat. No. 4,013,633; the arylazopyrazolotriazole and arylazopyridinol dyes of U.S. Pat. No. 4,142,891; the arylazo dyes of U.S. Pat. No. 4,156,609; the pyridylazopyrazole and pyrimidylazopyrazole dyes of U.S. Pat. No. 4,148,641; the pyridylazonaphthol dyes of U.S. Pat. No. 4,147,544; the arylazoisoquinolinol dyes of U.S. Pat. No. 4,186,642; and the arylazovinylol dyes of U.S. Pat. No. 4,148,643. Such dyes have good stability and exhibit good diffusion under conditions of color transfer usage. They are also compatible with known and commonly used mordants.

PUG can also be a photographic reagent, that is a moiety which, upon release from a compound of this invention, undergoes a reaction with components in the described photographic elements or assemblages. Photographic reagents which can be released by the compounds of this invention include development inhibitors, development accelerators, bleach inhibitors, bleach accelerators, couplers, developing agents, silver complexing agents, fixing agents, toning agents, hardening agents, tanning agents, fogging agents, antifogging agents and chemical or spectral sensitizing or desensitizing agents.

PUG's which form development inhibitors upon release from the compounds of this invention can be of any type known in the art. These include the development inhibitors described in U.S. Pat. Nos. 3,227,554; 3,384,657; 3,615,506; 3,617,291 and 3,733,201 and in U.K. Patent No. 1,450,479, the disclosures of which are incorporated herein by reference. Preferred development inhibitors are iodide and heterocyclic compounds such as mercaptotetrazoles, selenotetrazoles, mercaptobenzothiazoles, mercaptobenzimidazoles, seleneobenzimidazoles, benzotriazoles and benzodiazoles. Structures of preferred development inhibitor moieties are:

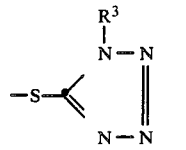

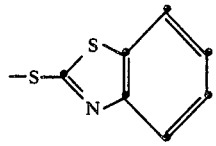

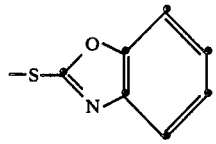

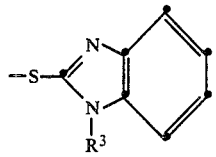

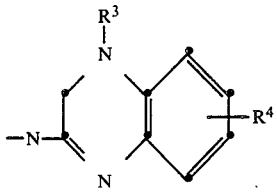

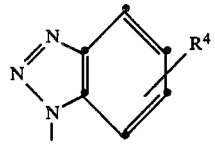

where $R^3$ is hydrogen alkyl of 1 to 8 carbon atoms (e.g. methyl, ethyl, butyl), phenyl or substituted phenyl and $R^4$ is hydrogen or one or more halogen atoms (e.g. chloro, fluoro, bromo or iodo), lower alkyl of 1 to 4 atoms or nitro groups.

The compounds of this invention are useful in positive-working image transfer systems. For example, where the released photographically useful group is a dye image-forming compound, a positive dye image is produced which is inverse to the development of silver halide. In a system of this type the more versatile and conventional negative silver halide emulsions can be used.

Representative nitrodiaromatic-substituted sulfonohydrazide compounds useful in this invention include:

WHERE PUG IS AN IMAGE DYE OR AN IMAGE DYE PRECURSOR
1.
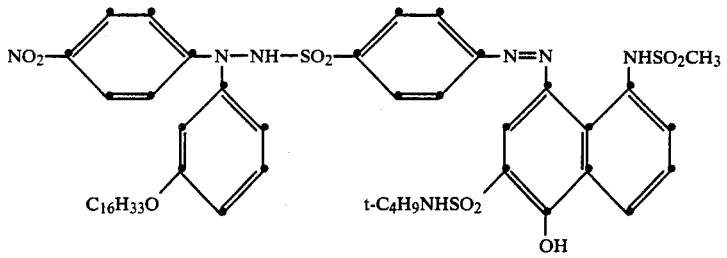
2.
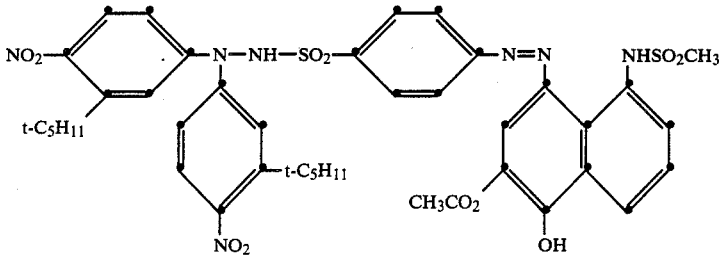
3.
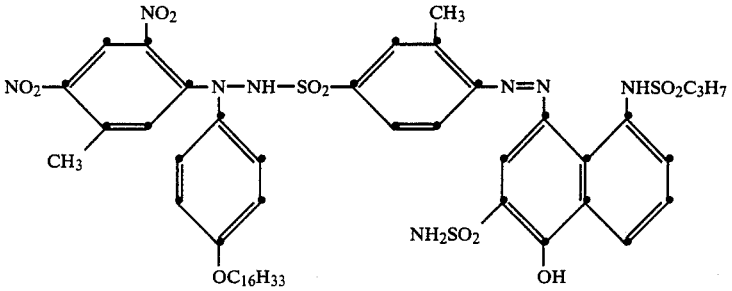
4.
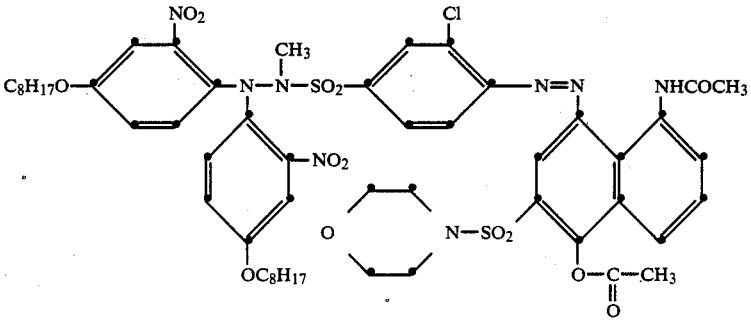
5.
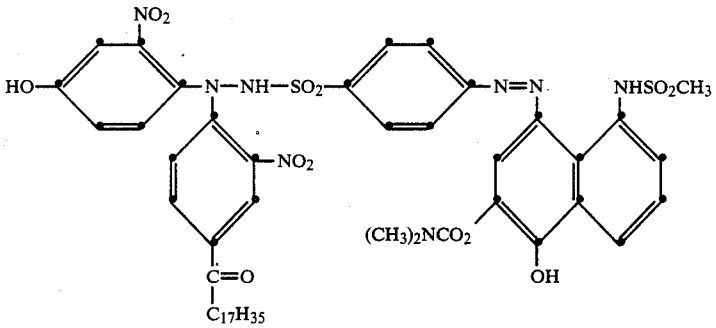

-continued
6.
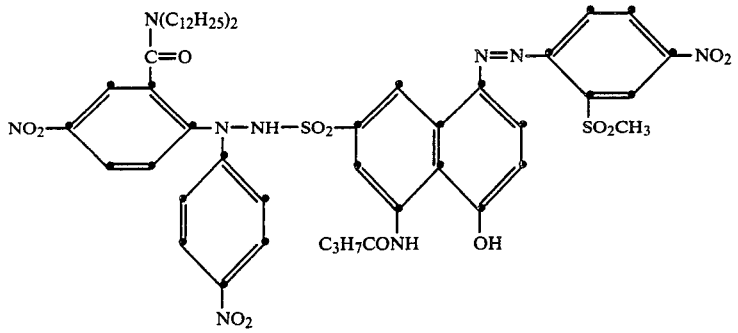
7.
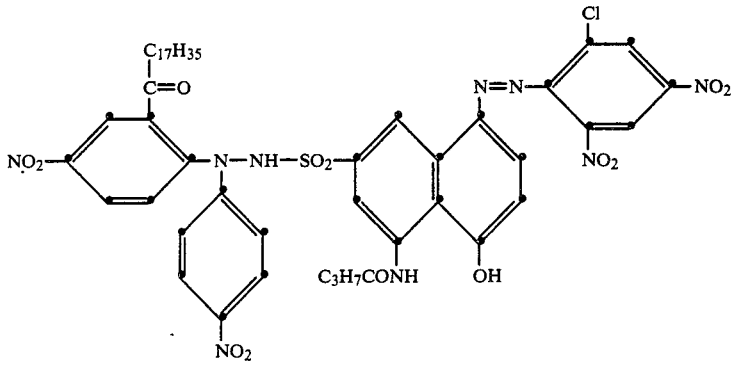
8.
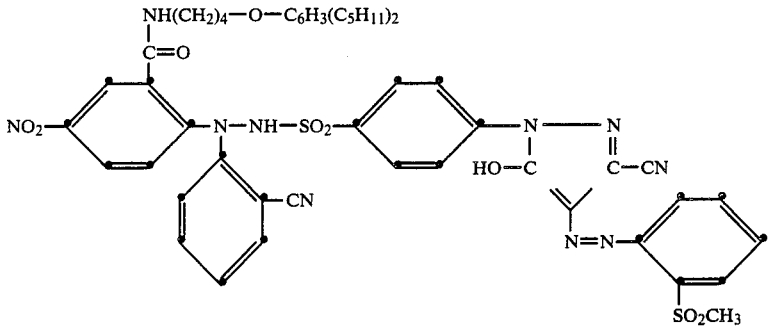
9.
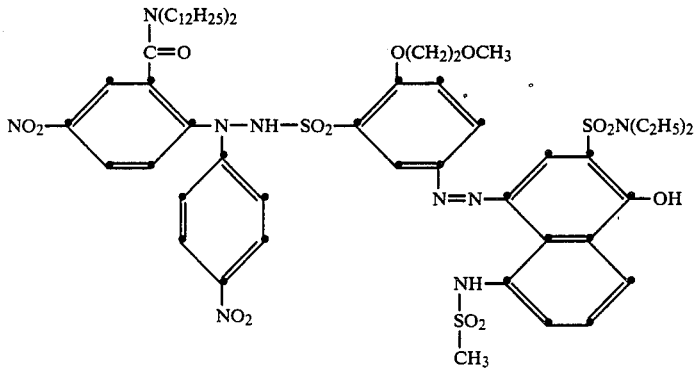
10.
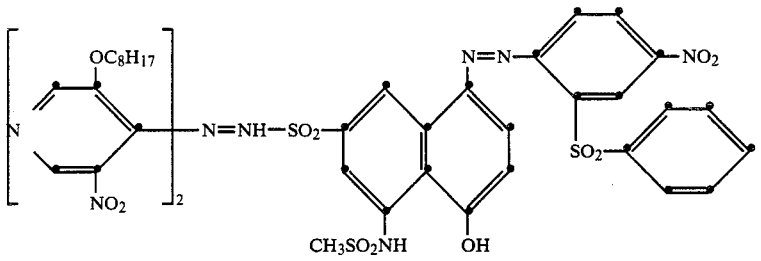

-continued

11.

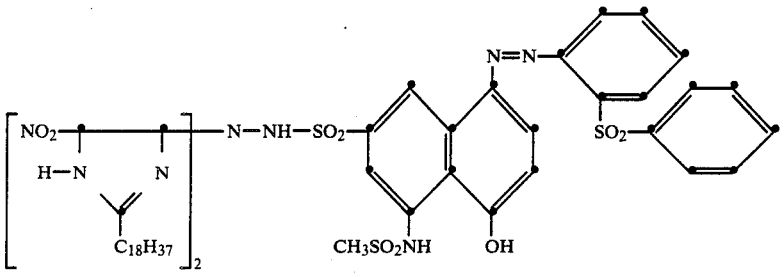

12.

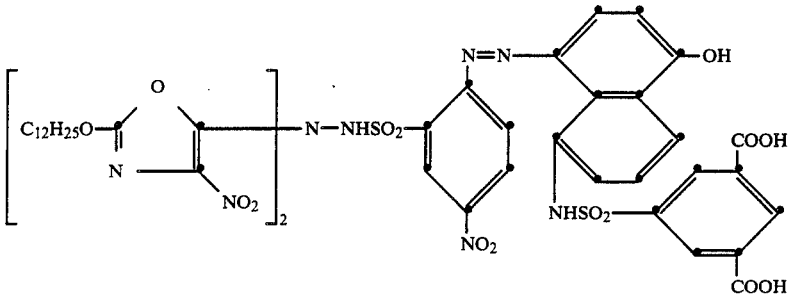

13.

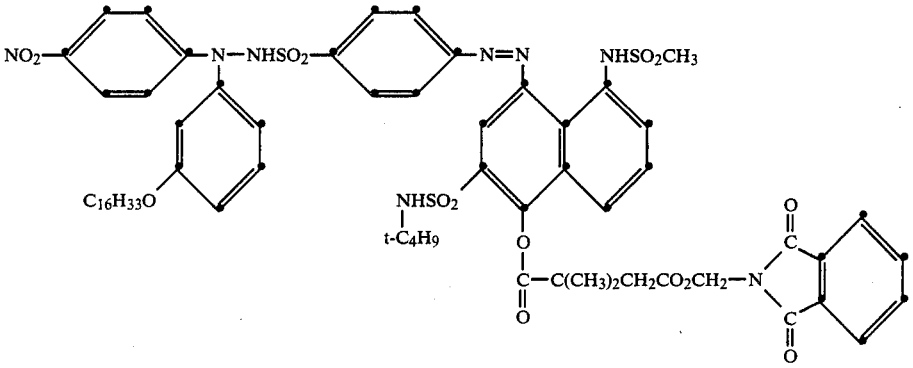

WHERE PUG IS A PHOTOGRAPHIC REAGENT OR A PHOTGRAPHIC REAGENT PRECURSOR

14.

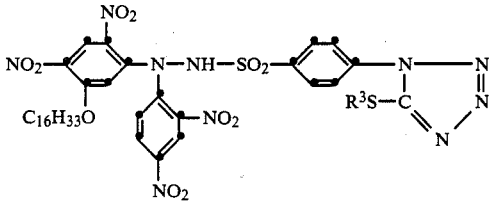

$R^3$=Hydrogen or a hydrolyzable group such as $$-\overset{O}{\overset{\|}{C}}OR^4 \text{ or } -O\overset{O}{\overset{\|}{C}}OR^4$$

where $R^4$ is alkyl having from 1 to 18 carbon atoms or aryl having from 6 to 18 carbon atoms.

15.

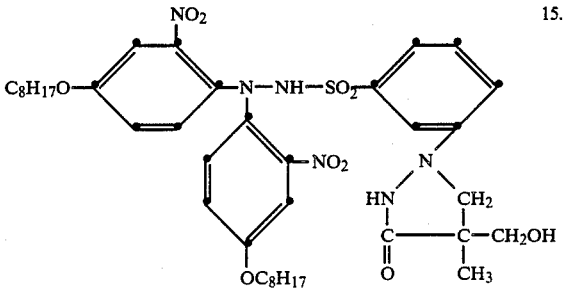

16.

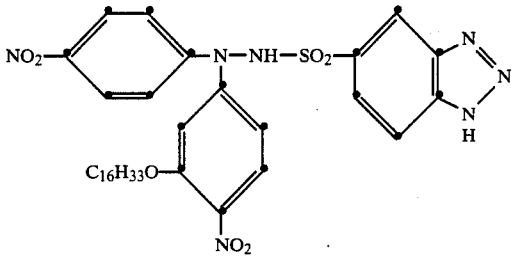

A preferred embodiment of the present invention comprises a photographic element comprising a support having thereon a red-sensitive silver halide emulsion layer having associated therewith an N',N'-di-aromatic carbocyclic-or diaromatic heterocyclic-sulfonohydrazide compound of this invention which is capable of releasing a cyan image dye-providing moiety, a green-sensitive silver halide emulsion layer having associated therewith an N',N'-di-aromatic carbocyclic- or diaromatic heterocyclic-sulfonohydrazide compound of this invention which is capable of releasing a magenta image dye-providing moiety and a blue-sensitive silver halide emulsion layer having associated therewith an N',N'-di-aromatic carbocyclic- or diaromatic heterocyclic-sulfonohydrazide compound of this invention which is capable of releasing a yellow image dye-providing moiety.

A photographic assemblage in accordance with this invention comprises:

(a) a photographic element comprising a support having thereon at least one photosensitive silver halide emulsion layer having associated therewith a nondiffusible N',N'-di-aromatic carbocyclic- or diaromatic heterocyclic-sulfonohydrazide compound capable of releasing a photographically useful group or precursor thereof, wherein at least one of said aryl groups comprises a nitro substituent in the 2- position or in a position conjugated thereto;

(b) a dye image-receiving layer; and (c) an alkaline processing composition with means for discharging same within said assemblage;

said assemblage also comprising a silver halide developing agent.

The processing composition may be inserted into the assemblage by interjecting processing solution with communicating members similar to hypodermic syringes which are attached either to a camera or camera cartridge. The processing composition can also be applied by means of a swab or by dipping into a bath. Another method of applying processing composition in the assemblage is the liquid spreading means described in U.S. Pat. No. 4,370,407.

The assemblage itself preferably contains the alkaline processing composition and means containing same for discharge within the assemblage. There can be employed, for example, a rupturable container which is adapted to be positioned during processing so that a compressive force applied to the container by pressure-applying members, such as would be found in a camera designed for in-camera processing, will effect a discharge of the container's contents within the assemblage.

Image-receiving layers which can be employed in the photographic assemblages of this invention can be any of those recognized in the art as providing the desired functions of mordanting or otherwise fixing the dye images. The choice of mordant will, at least in part, depend upon the dye to be mordanted and can be a basic polymeric mordant, such as described in U.S. Pat. Nos. 2,882,156; 3,625,694; 3,709,690; 3,898,088; 3,958,995; 3,859,096; or in the November 1976 edition of Research Disclosure, pages 80–82.

The dye image-receiving layer in the above-described assemblage is optionally located on a separate support adapted to be superposed on the photographic element after exposure thereof. Such an image-receiving element is generally disclosed in U.S. Pat. No. 3,362,819. When the means for discharging processing composition is a rupturable container, it is usually positioned in relation to the photographic element and the image-receiving layer so that a compressive force applied to the container by pressure-applying members, such as would be found in a typical camera used for in-camera processing, will effect a discharge of the container's contents between the image-receiving layer and the outermost layer of the photographic element. After processing, the dye image-receiving layer is separated from the photographic element.

The dye image-receiving layer in the above-described assemblage in another embodiment is located integrally with the photographic element between the support and the lowermost photosensitive silver halide emulsion layer. One useful format for integral receiver-negative photographic elements is disclosed in Belgian Patent No. 757,960. In such an embodiment, the support for the photographic element is transparent and is coated with an image-receiving layer, a substantially opaque light-reflective layer, e.g., $TiO_2$, and then the photosensitive layer or layers described above. After exposure of the photographic element, a rupturable container containing an alkaline processing composition and an opaque process sheet are brought into superposed position. Pressure-applying members in the camera rupture the container and spread processing composition over the photographic element as the film unit is withdrawn from the camera. The processing composition develops each exposed silver halide emulsion layer and dye images are formed as a function of development which diffuse to the image-receiving layer to provide a positive, right-reading image which is viewed through the transparent support on the opaque reflecting layer background. For other details concerning the format of this particular integral film unit, reference is made to the above-mentioned Belgian Patent No. 757,960.

Another format for integral negative-receiver photographic elements in which the present invention is useful is disclosed in Canadian Patent No. 928,559. In this embodiment, the support for the photographic element is transparent and is coated with the image-receiving layer, a substantially opaque, light-reflective layer and the photosensitive layer or layers described above. A rupturable container containing an alkaline processing composition and an opacifier is positioned adjacent the top layer and a transparent top sheet which has thereon a neutralizing layer and a timing layer. The film unit is placed in a camera, exposed through the transparent top sheet and then passed through a pair of pressure-applying members in the camera as it is being removed therefrom. The pressure-applying members rupture the container and spread processing composition and opacifier over the negative portion of the film unit to render it light-insensitive. The processing composition develops each silver halide layer and dye images, formed as a result of development, diffuse to the image-receiving layer to provide positive, right-reading images which are viewed through the transparent support on the opaque reflecting layer background. For further details concerning the format of this particular integral film unit, reference is made to the above-mentioned Canadian Patent No. 928,559.

Still other useful integral formats in which this invention can be employed are described in U.S. Pat. Nos. 3,415,644; 3,415,645; 3,415,646; 3,647,437 and 3,635,707. In most of these formats, a photosensitive silver halide emulsion is coated on an opaque support and a dye image-receiving layer is located on a separate transparent support superposed over the layer outermost from the opaque support. In addition, this transparent support also preferably contains a neutralizing layer and a timing layer underneath the dye image-receiving layer.

A preferred photographic assemblage in accordance with the invention comprises:

(a) a photographic element comprising a support having thereon the following layers in sequence: a dye image-receiving layer, a stripping layer, a substantially opaque layer and a photosensitive silver halide emulsion layer having associated therewith a dye image-providing compound as described above;

(b) a transparent cover sheet superposed over the silver halide emulsion layer; and (c) an opaque alkaline processing composition and means containing same for discharge, during processing, between the cover sheet and the photosensitive element.

Any material may be employed as the stripping layer in the photographic assemblage described above provided it will perform the desired function of cleanly stripping. Such materials are disclosed, for example in U.S. Pat. Nos. 3,220,835; 3,730,718 and 3,820,999 and include gum arabic, sodium alginate, pectin, polyvinyl alcohol and hydroxyethyl cellulose. Hydroxyethyl cellulose is preferably employed as the stripping layer.

The stripping layer materials employed in the assemblage described above can be employed in any amount which is effective for the intended purpose. Good results are obtained at a concentration of from about 5 to about 2000 mg/m$^2$ of element. The particular amount to be employed will vary depending on the particular stripping layer material employed and the nature of the other layers of the diffusion transfer element.

The concentration of compound that is employed in the present invention to release a PUG may be varied over a wide range, depending upon the particular PUG sought to be released and the results which are desired. For example, where an image dye or image dye-precursor is desired, a compound of the present invention may be coated in a silver halide emulsion layer or in a layer adjacent thereto. Coating can be accomplished by using a solution containing between about 0.5 and about 8 percent by weight of the compound distributed in a hydrophilic film-forming natural material or synthetic polymer, such as gelatin, polyvinyl alcohol, etc., which can be permeated by aqueous alkaline processing composition.

Where the PUG to be released is other than an image dye or dye-providing compound, the compounds of this invention containing such PUG may be utilized in various layers of the described photographic element and in varying concentrations to ensure release of the desired amount of PUG.

The photographic element described above can be treated in any manner with an alkaline processing composition to effect or initiate development. A preferred method for applying processing composition is by use of a rupturable container or pod which contains the composition. In general, the processing composition contains a developing agent, although the composition could be an alkaline solution with the developing agent being incorporated in the photographic element or cover sheet. In the latter case the alkaline solution serves to activate the incorporated developer.

A variety of silver halide developing agents or electron transfer agents (ETA's) are useful in this invention. In certain embodiments of the invention, any ETA can be employed as long as it cross-oxidizes with the dye-providing compounds described herein. The ETA may also be incorporated in the photosensitive element to be activated by the alkaline processing composition. Specific examples of ETA's useful in this invention include hydroquinone compounds, catechol compounds, and 3-pyrazolidinone compounds as disclosed in column 16 of U.S. Pat. No. 4,358,527. A combination of different ETA's, such as those disclosed in U.S. Pat. No. 3,039,869, can also be employed. These ETA's are employed in the liquid processing composition or contained, at least in part, in any layer or layers of the photographic element or assemblage to be activated by the alkaline processing composition, such as in a silver halide emulsion layer, a separate dye image-providing compound layer, an interlayer or an image-receiving layer.

In a preferred embodiment of the invention, the silver halide developer or ETA employed becomes oxidized upon development and reduces silver halide to silver metal. The oxidized developer then cross-oxidizes the compound of this invention. The product of cross-oxidation then undergoes alkaline hydrolysis, thus releasing an imagewise distribution of PUG which is then free to diffuse through the photographic element to provide the desired result.

Release of the PUG occurs as a result of rupturing the bond between the two nitrogen atoms of the N',N'-diaromatic carbocyclic- or diaromatic heterocyclic-sulfonohydrazide compound. The released PUG moiety has attached thereto the —NR—$SO_2$— fragment which, due to its solubility in alkaline media, facilitates diffusion of the released PUG in the photographic element during processing.

In using the compounds according to the invention which release diffusible dyes as a function of development, either conventional negative-working or direct-positive silver halide emulsions are employed. If the silver halide emulsion employed is a conventional negative-working emulsion a positive image will be obtained in the image-receiving layer. Use of a direct-positive emulsion will produce a negative image in the image-receiving layer. Such a negative can be used to produce positive prints.

The film unit or assemblage of this invention can be used to produce positive images in single or multicolors, when used in a three-color system, each silver halide emulsion layer will have associated therewith a compound capable of releasing a PUG which is an image dye, or image dye precursor, which has a predominant spectral absorption within the region of the visible spectrum to which said silver halide emulsion is sensitive. The compound which releases the dye, or dye precursor, is contained either in the silver halide emulsion layer or in a layer contiguous thereto.

The various silver halide emulsion layers of a color film assemblage employed in this invention are generally disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in certain embodiments of this invention is disclosed in U.S. Pat. Nos. 2,543,181; 2,643,886; 3,653,732; 2,723,051; 3,056,492; 3,056,491 and 3,152,515. Such containers usually comprise a rectangular sheet of fluid-and-air-impervious material folded longitudinally upon itself to form two walls which are sealed to one another along their longitudinal and end margins to form a cavity in which processing composition is contained.

Except where noted otherwise, the silver halide emulsion layers employed in the invention comprise photosensitive silver halide dispersed in gelatin along with the dye-providing compounds.

Scavengers for oxidized developing agent can be employed in various interlayers of the photographic elements of the invention. Suitable materials are disclosed on page 83 of the November 1976 edition of *Research Disclosure,* the disclosure of which is hereby incorporated by reference.

Use of a neutralizing material in photographic elements of this invention will usually increase the stability of the transferred image since it will effect a reduction in the pH of the image layer from about 13 or 14 to at least 11, and preferably 5 to 8, within a short time after imbibition. Suitable materials and their functioning are disclosed on pages 22 and 23 of the July 1974 edition of *Research Disclosure,* and pages 35 through 37 of the July 1975 edition of *Research Disclosure,* the disclosures of which are hereby incorporated by reference.

A timing or inert spacer layer can be employed over the neutralizing layer which "times" or controls the pH reduction as a function of the rate at which alkali diffuses through the inert spacer layer. Examples of such timing layers and their functioning are disclosed in the *Research Disclosure* articles mentioned in the paragraph above concerning neutralizing layers.

The alkaline processing composition employed in this invention is the conventional aqueous solution of an alkaline material, e.g., alkali metal hydroxides or carbonates such as sodium hydroxide, sodium carbonate or an amine such as diethylamine, preferably possessing a pH in excess of 11, and preferably containing a developing agent as described previously. Suitable materials and addenda frequently added to such compositions are disclosed on pages 79 and 80 of the November 1976 edition of *Research Disclosure,* the disclosure of which is hereby incorporated by reference.

The alkaline solution-permeable, substantially opaque, light-reflective layer employed in certain embodiments of photographic assemblages used in this invention is described more fully in the November 1976 edition of *Research Disclosure,* page 82, the disclosure of which is hereby incorporated by reference.

The supports for the photographic elements used in this invention can be any material as long as it does not deleteriously affect photographic properties and is dimensionally stable. Typical flexible sheet materials are described on page 85 of the November 1976 edition of *Research Disclosure,* the disclosure of which is hereby incorporated by reference. The supports may be either opaque for obtaining a reflection print or clear or semi-translucent for obtaining a transparency. If transparencies are obtained, they may be viewed through the support side or the opposite side depending upon the "viewing" required.

The silver halide emulsions useful in this invention are well known to those skilled in the art. They are described in *Research Disclosure,* Volume 176, December 1978, Item No. 17643, pages 22 and 23, "Emulsion preparation and types", and are usually chemically and spectrally sensitized as described on page 23, "Chemical sensitization", and "Spectral sensitization and desensitization", of the above article; they are optionally protected against the production of fog and stabilized against loss of sensitivity during keeping by employing the materials described on pages 24 and 25, "Antifoggants and stabilizers", of the above article; they usually contain hardeners and coating aids as described on page 26, "Hardeners", and pages 26 and 27, "Coating aids", of the above article; they and other layers in the photographic elements used in this invention usually contain plasticizers, vehicles and filter dyes described on page 27, "Plasticizers and lubricants"; page 26, "Vehicles and vehicle extenders"; and pages 25 and 26, "Absorbing and scattering materials", of the above article; they and other layers in the photographic elements used in this invention can contain addenda which are incorporated by using the procedures described on page 27, "Methods of addition", of the above article; and they are usually coated and dried by using the various techniques described on pages 27 and 28, "Coating and drying procedures", of the above article, the disclosures of which are hereby incorporated by reference.

The term "nondiffusing" used herein has the meaning commonly applied to the term in photography and denotes materials that for all practical purposes do not migrate or wander through organic colloid layers such as gelatin in an alkaline medium, in the photographic elements of the invention and preferably when processed in a medium having a pH of 11 or greater. The same meaning is to be attached to the term "immobile". The term "diffusible" as used herein has the converse meaning and denotes materials having the property of diffusing effectively through the colloid layers of the photographic elements in an alkaline medium in the presence of "nondiffusing" materials. "Mobile" has the same meaning.

The term "associated therewith" as used herein is intended to mean that the materials can be in either the same or different layers so long as the materials are accessible to one another.

The nitrodiaryl-substituted redox dye releasing (RDR) compounds of this invention can be synthesized either by reaction of an aldehyde hydrazone, such as benzaldehyde, 1-naphthaldehyde or picolinaldehyde (Synthesis 1, below), or from a nitrosubstituted aromatic amine, such as p-nitroaniline (Synthesis 2, below).

Synthesis 1

The schematic representation presented below describes the preparation of positive RDR Compound No. 1, wherein the PUG which is released is a magenta dye:

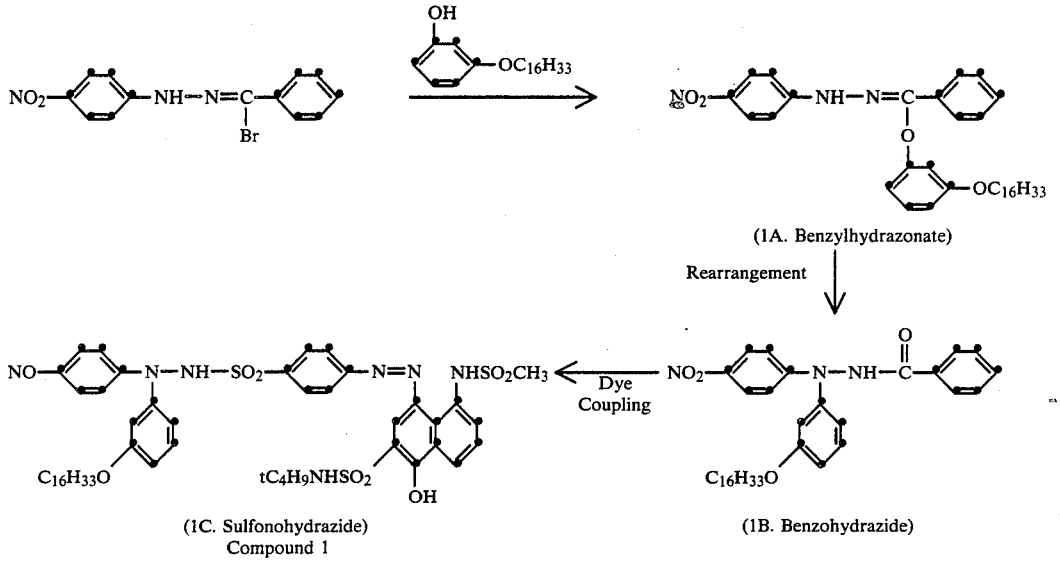

Synthesis of the benzylhydrazonate:

m-Hexadecyloxyphenol (7.5 g, 22.4 mmol) was added in small portions to a 50 percent sodium hydroxide dispersion, (1.2 g, 25 mmol) in toluene (100 ml) under nitrogen. After 20 minutes, the resulting suspension was cooled and a solution of p-nitrophenylbenzohydrazonyl bromide (5 g, 15.6 mmol)* in 30 ml tetrahydrofuran was added dropwise. After 4 hours at room temperature (22° C.), the reaction was extracted with ether, washed with 10 percent hydrochloric acid and dried with anhydrous magnesium sulfate. After filtering, the solvents were removed and the resulting solid was purified by silica gel column chromotography eluting with dichloromethane/cyclohexane mixtures. The product, m-hexadecyloxyphenyl-p-nitrophenylbenzylhydrazonate (1A) was crystallized from ligroin at −78° C. (mp 77°-78° C.).

*p-Nitrophenylbenzohydrazonyl bromide was prepared from the p-nitrophenyl hydrazone of benzaldehyde as described in Tetrahedron, 28, 5903 (1972) and J. Chem. Soc., Perkin II, 1422 (1973).

Rearrangement of the benzylhydrazonate:

The hydrazonate (IA) (4 g,7.8 mmol) was heated under nitrogen at 210° C. for 4 hours. The resulting rearranged product, 3-hexadecyloxy-3'- nitrodiphenyl-N'-benzohydrazide (1B) (mp 74°-75°C.), was recrystallized from acetonitrile.

Synthesis of the sulfonohydrazide (Compound 1):

The hydrazide (1B) (2.5 g, 4.4 mmole) was added to 50 percent sodium hydride dispersion (1 g, 20 mmol) in tetrahydrofuran (75 ml) under nitrogen. The resulting dark red solution was cooled in an ice bath and dye sulfonyl chloride (3 g, 5.2 mmol)** was added. The reaction mixture was warmed to room temperature (22° C.) overnight and treated with water (3 ml) followed by IN sodium hydroxide (10 ml). After 30 minutes, the reaction mixture was poured over ice and hydrochloric acid and the resulting red precipitate was purified by silica gel column chromotography eluting with acetic acid, ethyl acetate/cyclohexane mixtures and trituration with methanol to yield 2.5 g, (58 percent) of the sulfonohydrazide product, Compound 1.

**The dye sulfonyl chloride was prepared as described in Example 3 of U.S. Pat. No. 3,932,380 with the exception that the coupling reaction to form the dye was carried out prior to the reaction to unite the dye moiety to the carrier moiety of the present invention.

Synthesis 2

The schematic representation presented below describes preparation of positive RDR Compound 1 by the following sequence:

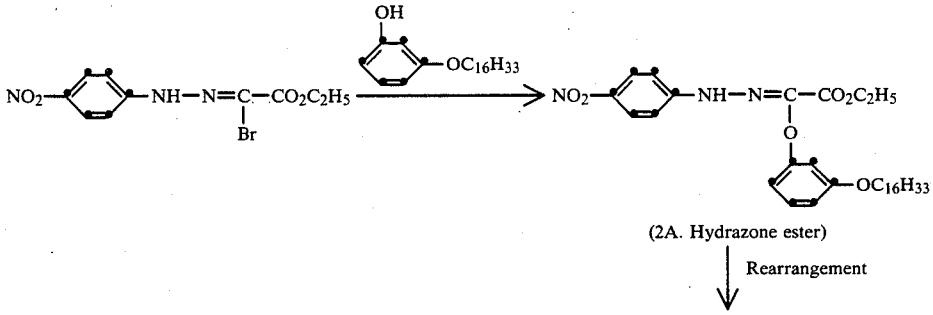

-continued

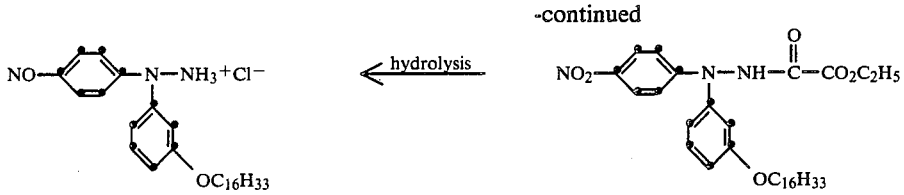

(2C. Nitrophenylhydrazine HCl) (2B. Rearranged product of 2A)

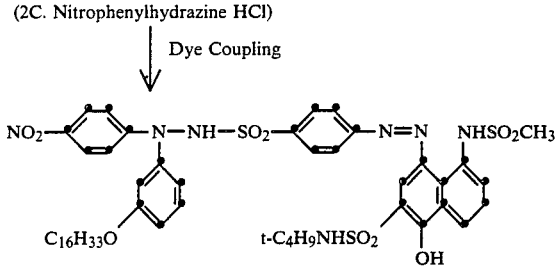

(Compound 1)

Synthesis of hydrazone ester:

Ethyl-α-bromoglyoxylate-p-nitrophenylhydrazone (5 g, 15.8 mmol)* and m-hexadecyloxyphenol (5.3 g, 15.8 mmol) were stirred together in a mixture of dichloromethane (100 ml) and water (20 ml) containing potassium hydroxide (1 g, 17.8 mmol). After 30 minutes, additional dichloromethane (200 ml) was added. The reaction was neutralized with 10 percent hydrochloric acid and the mixture was then dried over anhydrous magnesium sulfate. Purification by silica gel chromatography, eluting with dichloromethane/cyclohexane mixtures, and crystallization from ligroin yielded ethyl-α-hexadecyloxyphenylglyoxylate-p-nitrophenyl hydrazone (2A) (mp 99°–100° C.).

*Ethyl α-bromoglyoxylate p-nitrophenylhydrazone was prepared as described in JACS, 68 589 (1951).

Rearrangement and hydrolysis of the nitrophenyl hydrazone ester:

The hydrazone ester (2A) (22 g) was heated at 210° C. for 30 minutes under nitrogen. The resulting rearranged oily product (2B), which solidified upon standing, was refluxed overnight in ethanol (75 ml) containing concentrated hydrochloric acid (5 ml). Upon cooling in an ice bath, the yellow solid that formed was collected and recrystallized from acetonitrile to yield (82 percent) N-3-hexadecyloxyphenyl-N-4-nitrophenylhydrazine.HCl (2C).

Synthesis of the sulfonohydrazide (Compound 1):

2C. The hydrazine (2C) (1 g, 2 mmol) and the dye sulfonyl chloride (1.2 g, 2 mmol)** was stirred together in pyridine (20 ml) for 3 hours at room temperature (22° C.). The reaction was poured onto ice and hydrochloric acid and the red precipitate that formed was collected and purified by silica gel chromatography. This material was identical to the sulfonohydrazide product synthesized in 1C.

**Prepared by a method described above in Synthesis 1.

Synthesis 3 - Blocked Compound 13

Positive RDR Compound 1 (1.2 g, 1.2 mmole) was reacted with mono-(phthalimidomethyl)-2,2-dimethyl succinoyl chloride (1.5 g) in dichloromethane (50 ml) containing pyridine (5 equivalents). After stirring overnight at room temperature (22° C.) additional dichloromethane (50 ml) was added, followed by washing with 10 percent hydrochloric acid and drying over anhydrous magnesium sulfate. Purification by silica gel column chromatography yielded blocked RDR Compound 13 having the structural formula:

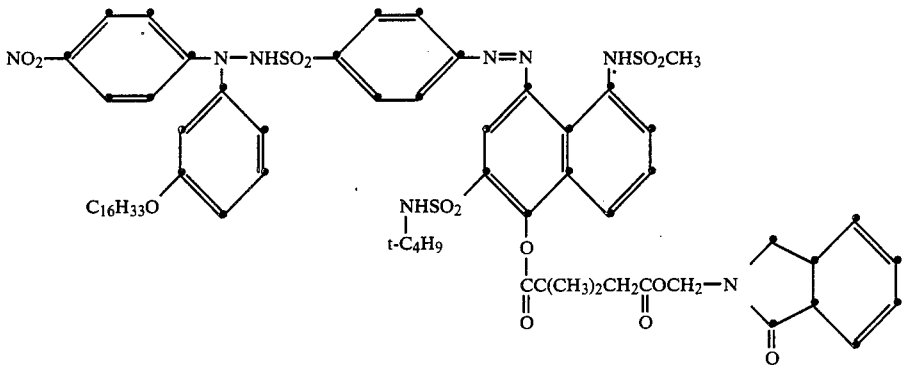

EXAMPLE 1

To illustrate imaging and rate of dye release of sulfonohydrazide compounds of this invention, as compared with a prior art compound, the following integral imaging receiver elements were prepared by coating the described layers, in the order recited, on a transparent poly(ethylene terephthalate) support. Coverages are in (g/m$^2$), and all parts, percents and ratios are by weight, unless otherwise specified:

1. image-receiving layer of poly(styrene-co-N-vinylbenzyl-N-benzyl-N,N-dimethylammonium chloride-co-N-vinylbenzene) (99:99:2 mole ratio) (2.3) and gelatin (2.3);

2. reflecting layer of titanium dioxide (19) and gelatin (3.0);

3. opaque layer of carbon black (1.9) and gelatin (1.2);

4. imaging layer of green sensitive negative silver bromoiodide emulsion (1.3 Ag), magenta redox dye releasing compound (0.27 mmol/m$^2$) as identified in Table 1, incorporated reducing agent* (0.48 mmol/m$^2$) and gelatin (2.1);

*The incorporated reducing agent in layer 4, which has the following structural formula, was dispersed in N,N-diethyllauramide solvent at a 2:1 agent:solvent ratio:

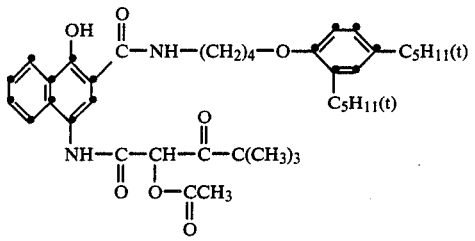

5. overcoat layer of gelatin (0.55) and bis(vinylsulfonyl)methyl ether at 1.25 percent of the total gelatin weight.

Cover sheets were prepared by coating the following layers, in the order recited, on a poly(ethylene terephthalate) film support:

(1) acid layer comprising poly(n-butyl acrylate-co-acrylic acid) (30:70 weight ratio equivalent to 140 meq. acid/m$^2$); and (2) timing layer comprising a 1:1 physical mixture of the following two polymers coated at 4.8 g/m$^2$:

(a) poly(acrylonitrile-co-vinylidene chloride-co-acrylic acid) wt. ratio 14:79:7), and (b) a lactone polymer, partially hydrolyzed and 1-butanol transesterified poly(vinyl acetate-co-maleic anhydride) (ratio of acid/butyl ester 15:85).

Two viscous processing compositions were prepared:

| | Composition A | Composition B |
|---|---|---|
| Potassium hydroxide | 51. g/l (of water) | 51. g/l |
| 4-Hydroxymethyl-4-methyl-1-p-tolyl-3-pyrazolidinone | 4.0 g/l | — |
| Carboxymethylcellulose | 50. g/l | 57. g/l |
| Potassium bromide | 10. g/l | — |
| Sodium sulfite | 2.0 g/l | 2.0 g/l |
| Ethylenediamine tetraacetic acid (disodium salt) | 7. g/l | 10. g/l |
| Carbon | 172 g/l | — |

Each integral image-receiving (IIR) element was exposed to a graduated density test object to yield a full-scale D-max/D-min image. The exposed elements were processed using viscous processing Composition A contained in a pod. The processing composition was spread between an IIR and a cover sheet using a pair of juxtaposed rollers to provide a fluid gap of 75 μm. After three hours the Status A green density of the receiver side of the IIR was read to obtain the D-max and D-min values tabluated below.

TABLE

| RDR | Image Discrimination Dmin/Dmax | Δ |
|---|---|---|
| Compound 1 | 0.22/1.4 | 1.18 |
| Compound 13 | 0.20/2.0 | 1.80 |

TABLE-continued

| RDR | Image Discrimination Dmin/Dmax | Δ |
|---|---|---|
| Prior Art* | 0.36/1.2 | 0.84 |

*Sulfilimine dye releasing compound of the type disclosed in U.S. Pat. No. 4,369,243 having the same releasable magenta dye moiety as Compound 1:

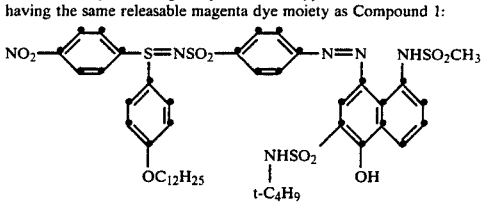

As the data in the above Table indicate, improved image discrimination is obtained for the compounds of this invention as compared with the sulfilimine RDR compound of the prior art. Comparable dye release rates were obtained for all three RDR compounds.

This invention has been described in detail with particular reference to preferred embodiments thereof. However, it will be apparent that variations and modifications can be effected within the spirit and scope of the invention.

What is claimed is:

1. A photographic element comprising a support having thereon at least one photosensitive silver halide emulsion layer and also comprising, in said silver halide layer or in a layer adjacent thereto, a nondiffusible N',N'-di aromatic carbocyclic or aromatic heterocyclic sulfonohydrazide compound, or a precursor thereof, capable of releasing a diffusible photographically useful group wherein at least one of said aromatic groups comprises a nitro substituent in the 2- position or in a position conjugated thereto.

2. The photographic element according to claim 1 wherein said nondiffusible compound is represented by the structural formula:

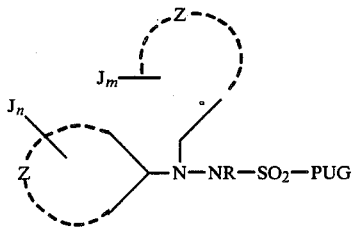

where each Z independently represents the atoms necessary to complete a substituted or an unsubstituted one- or a two-ring aromatic carbocyclic or aromatic heterocyclic group containing 5 to 7 nuclear atoms in each ring, J is a nitro group substituted in the 2- position or in a position conjugated thereto;

m and n are integers of 0, 1 or 2 with the proviso that either m or n is at least 1;

R is hydrogen or an alkyl group having from 1 to about 6 carbon atoms; and

PUG is a photographically useful group.

3. The photographic element according to claim 2 wherein each Z represents the atoms necessary to complete a benzene, pyridine, diazine, naphthalene, quinoline, furan, thiophene, pyrrole, isoxazole, benzofuran, benzothiofuran, indole, indene or azulene ring.

4. A photographic element according to claim 3 wherein at least one ring completed by Z is substituted with a straight chain alkyl or alkoxy group having from 1 to about 30 carbon atoms; an aryl group having from 6 to about 30 carbon atoms; a halogen atom; a carbamoyl group having the formula —CON($R^2$)$_2$ or a sulfamoyl group having the formula -$SO_2N(R^2)_2$, where each $R^2$ independently represents a hydrogen atom; an alkyl or an alkoxy group having from 1 to about 30 carbon atoms or an aryl or an aryloxy group having from 6 to about 30 carbon atoms.

5. The photographic element according to claim 2 wherein a ballast group is substituted on at least one ring completed by Z.

6. The photographic element according to claim 5 wherein the ballast group has at least 8 carbon atoms.

7. The photographic element according to claim 2 wherein PUG is a dye or a dye precursor compound.

8. The photographic element according to claim 2 wherein PUG is a development inhibitor, a development accelerator, a bleach inhibitor, a bleach accelerator, a coupler, a developing agent, a silver complexing agent, a fixing agent, a toning agent, a hardening agent, a tanning agent, a fogging agent, an antifogging agent, a chemical sensitizing agent, a spectral sensitizing agent or a desensitizing agent.

9. The photographic element according to claim 2 wherein J is substituted in the 2- position of said carbocyclic or heterocyclic ring.

10. The photographic element according to claim 2 wherein J is substituted in the 4- position of said carbocyclic or heterocyclic ring.

11. The photographic element according to claim 1 wherein said nondiffusible compound is:

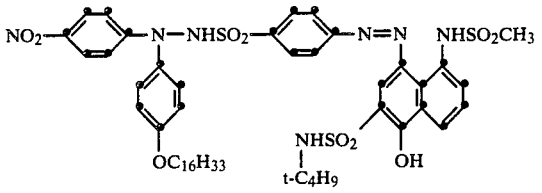

12. The photographic element according to claim 1 wherein said nondiffusible compound is:

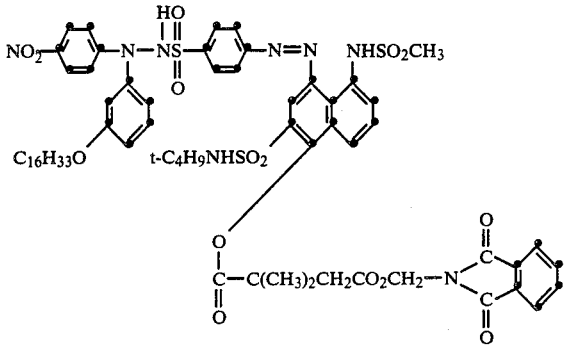

13. A photographic assemblage comprising:

(a) a photographic element according to any of claims 1 to 12;

(b) a dye image-receiving layer; and (c) an alkaline processing composition with means for discharging same within said assemblage;

said assemblage also comprising a silver halide developing agent.

* * * * *